United States Patent [19]

Salvi

[11] Patent Number: 4,683,871

[45] Date of Patent: Aug. 4, 1987

[54] CLOSURE FOR A COOKING OVEN

[76] Inventor: Francisco J. Salvi, 29 De Lebtiemibze, 1748 Lanus

[21] Appl. No.: 756,704

[22] Filed: Jul. 19, 1985

[30] Foreign Application Priority Data

Jul. 20, 1984 [AR] Argentina ..... 297.289

[51] Int. Cl.[4] ..... F24C 15/16

[52] U.S. Cl. ..... 126/340; 312/273

[58] Field of Search ..... 126/340, 339; 312/273, 312/281, 291, 274, 275, 270; 240/309.2; 62/266

[56] References Cited

U.S. PATENT DOCUMENTS

| | | | |
|---|---|---|---|
| 366,733 | 7/1887 | Millett | 126/340 |
| 725,783 | 4/1903 | Shanklin et al. | 126/340 |
| 1,023,646 | 4/1912 | Herndon | 312/273 |

*Primary Examiner*—James C. Yeung

*Attorney, Agent, or Firm*—Finnegan, Henderson, Farabow, Garrett & Dunner

[57] ABSTRACT

A cooking oven having a door with shelves attached to the inner surface. The oven chamber has substantially flat surfaces with the shelves being outside the oven chamber when the door is opened. A hinged plate is provided to cover the oven opening when the door is opened.

2 Claims, 2 Drawing Figures

CLOSURE FOR A COOKING OVEN

This invention relates to improvements in oven doors and includes a plate to block the oven opening when the door is in the open position.

This invention provides improved heat yield from the oven by eliminating heat losses that result with conventional ovens when the door is open and the interior of the oven is in direct communication with the ambient atmosphere.

In particular, the invention is applicable to kitchen range ovens of the type having a door which swings on a substantially vertical axis between closed and open positions. The inside of the oven opening is surrounded by a frame with sides which slope downwardly and toward the inside of the oven. On the top of the oven opening there is an internally hinged swinging plate which moves on a substantially horizontal axis between a position in which it rests by gravity against the sloped sides of the frame, and one in which it lies essentially parallel to the inside top of the oven. The inside surface of the door is equipped with means to move the plate from the first mentioned position to the second, and with means to support the food being cooked in the oven.

In accordance with the invention the food support means in the oven are shelves placed perpendicular to the plane of the oven door, and the means of movement includes a lateral projection of an upper shelf, extending from its rim adjacent to the plate, a similar, but shorter projection from the shelf, lying above it, and a curved convex upward lateral rail extending perpendicular to the upper shelf from the edge adjacent to the plate.

Figure 1:
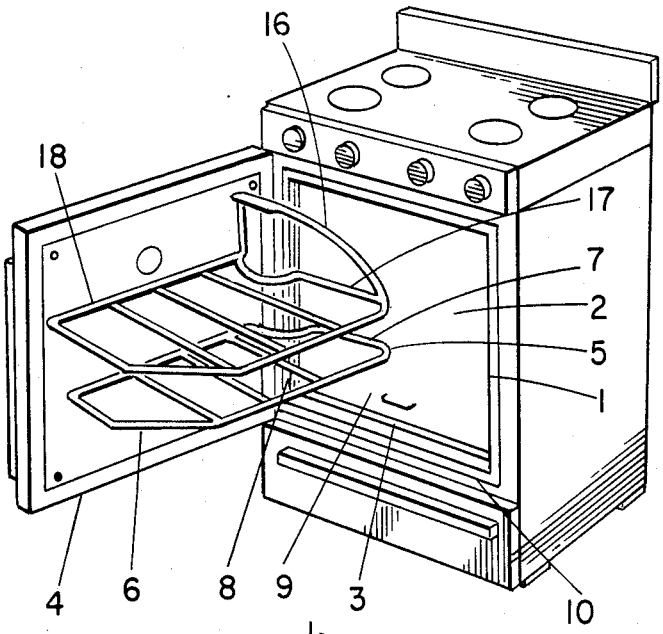
Figure 2:
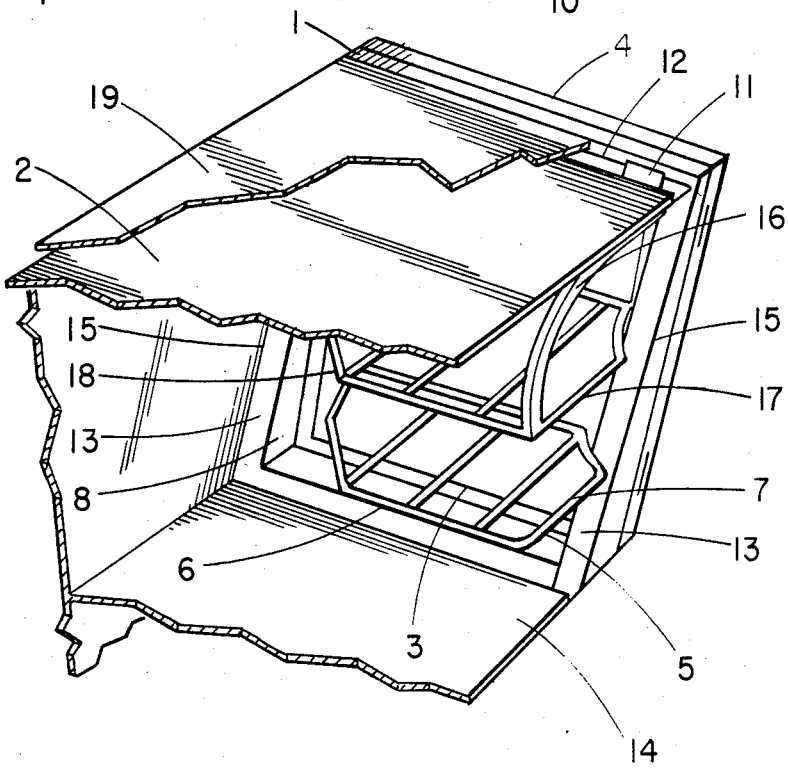

The improvements of the invention are shown in the accompanying drawings in an embodiment selected to be merely illustrative and in which:

FIG. 1 is a perspective view of a kitchen range provided with the improvements of the invention, shown with the oven door in an open position; and FIG. 2 is a perspective view of the interior of the range shown in FIG. 1, showing the oven door in the closed position, with the plate in accordance with the invention in a position substantially parallel to the oven top.

In all of the figures the parts of the invention which constitute improvements are identified with identical or matching referance numerals. The oven 1, has a door 4, which by means of hinges (not shown) swings on a substantially vertical axis between the open position shown in FIG. 1 and the closed position shown in FIG. 2.

On the inside of opening 3 of the oven 1 is installed a frame 13 with sides 15 sloping downwardly from above and toward the interior of the oven as shown in FIG. 2.

On the upper side 12 of this frame there is a removable hinged plate 2 which matches the oven opening, and is hinged to rotate on a horizontal axis along the upper edge 12 of the frame between a position as shown in FIG. 1, where it is held by gravity against the sides 15, and one as shown in FIG. 2, where it lies substantially parallel to the inner ceiling 19 of the oven 1.

The inner face of the door is provided with at least one lower shelf 6 and one upper shelf 18, providing a means to support the food being cooked in the oven. The lower shelf 6 has a lateral projection 5, which extends from its edge 7 adjacent to the plate 2, while the upper shelf 18 carries the lateral projection 17, also adjacent to the plate 2, which is shorter than projection 5, so that the edges of both projections describe a plane of the same slope as the sides 15 of the frame 13 surrounding the inside of the oven opening.

Likewise the upper shelf 18 has, at the edge of projection 17, a curved rail 16 which is convex in an upward direction against the plane of shelf 18 as can be seen in the figures. Space 8 separates shelves 6 and 18 so that food items can be placed upon shelf 6 and under shelf 18.

Thus, when the door 4 of the opening 3 to the oven 1 is closed, the edge 7 and the edge of the lateral projection 17 exert pressure against the outer surface 9 of the plate 2 raising it gradually as the door 4 is closed by means of a swinging action, which is completed by the action of the edge of the rail 16 to the position shown in FIG. 2, which is substantially parallel to the inner ceiling 19 of the oven 1.

Reference numeral 10 designates the outer bottom portion of the opening 3 of the oven 1; numeral 11 designates hinges which, acting as a hook, permit the removable suspension on the upper side 12 of the frame of the opening of the oven 1. The bottom of the oven is indicated by numeral 14.

The invention has been described and illustrated in one preferred embodiment, but modifications may be made without departure from the invention as defined in the claims.

I claim:

1. An oven comprising an oven chamber having an opening through which articles may be inserted and removed from the oven chamber, a door connected to said oven adjacent said opening and adapted to swing on a substantially vertical axis between a blocked position and an unblocked position relative to said oven chamber opening, a frame surrounding said opening and having flat sides sloping downwardly from an interior top portion of said opening and toward said oven chamber, a hinged plate constructed to substantially conform to said opening, said plate having a hinged connection at said top portion of said opening and thereby adapted to swing on a substantially horizontal axis between a closed position at which said plate rests against said flat sides of said frame to cover said opening and an open position at which said plate is within said oven chamber and substantially parallel with said top portion of said opening, said door having an inner surface to which is attached an upper horizontal shelf and a lower horizontal shelf adapted to support products for baking in said oven chamber, said lower shelf having a lateral projection extending from an edge thereof adjacent said plate and said upper shelf having a shorter lateral projection extending from an edge thereof adjacent said plate and a curved lateral rail extending upwardly from and being generally perpendicular to said upper shelf at said shorter lateral projection thereof, and said lateral projection, said shorter lateral projection and said curved lateral rail being adapted to sequentially engage said plate to move said plate from said closed position to said open position when said door swings from said unblocked position to said blocked position.

2. The oven of claim 1 wherein said opening and said plate are of substantially rectangular configuration.

* * * * *